US010450748B2

(12) United States Patent
Reaveley et al.

(10) Patent No.: US 10,450,748 B2
(45) Date of Patent: Oct. 22, 2019

(54) STRUCTURAL BRACES AND RELATED METHODS

(71) Applicants: Tyler J. Ross, Willard, UT (US); University of Utah Research Foundation, Salt Lake City, UT (US)

(72) Inventors: Lawrence D. Reaveley, Draper, UT (US); Tyler J. Ross, Willard, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 14/841,231

(22) Filed: Aug. 31, 2015

(65) Prior Publication Data

US 2016/0060888 A1 Mar. 3, 2016

Related U.S. Application Data

(60) Provisional application No. 62/044,124, filed on Aug. 29, 2014, provisional application No. 62/080,918, filed on Nov. 17, 2014.

(51) Int. Cl.
*E04C 3/32* (2006.01)
*E04C 3/36* (2006.01)
(Continued)

(52) U.S. Cl.
CPC ..... *E04C 3/32* (2013.01); *E04C 3/36* (2013.01); *E04H 9/02* (2013.01); *E04C 2003/026* (2013.01); *E04H 9/028* (2013.01)

(58) Field of Classification Search
CPC ..... E04H 2009/026; E04H 9/02; E04H 9/021; E04H 9/022; E04H 9/024; E04H 9/025; E04H 9/027; E04H 9/028; E04C 2003/026
(Continued)

(56) References Cited

U.S. PATENT DOCUMENTS 1,236,664 A 8/1917 Borgeson
5,842,312 A * 12/1998 Krumme ..... B63B 21/502 248/634
(Continued)

FOREIGN PATENT DOCUMENTS

JP S5238752 3/1977

OTHER PUBLICATIONS

International Search Report and Written Opinion issued in PCT/US2015/061172 dated Feb. 17, 2016.

*Primary Examiner* — Jessica L Laux
(74) *Attorney, Agent, or Firm* — Workman Nydegger

(57) ABSTRACT

A structural device includes a first deformable member configured to absorb at least a portion of a load resulting from relative displacement between structural members of a building. The first deformable member exhibits elastic deformation when subjected to tensile and/or compressive forces within a first range of forces, and exhibits plastic deformation when subjected to tensile and/or compressive forces within a second range of forces. A second deformable member is affixed to a portion of the first deformable member, and is configured to absorb at least another portion of the load resulting from the relative displacement between the structural members of the building. The second deformable member exhibits elastic deformation when subjected to tensile and/or compressive forces within a third range of forces, and exhibits plastic deformation when subjected to tensile and/or compressive forces within a fourth range of forces. Methods relate to forming structural devices.

20 Claims, 10 Drawing Sheets

(51) Int. Cl.
*E04H 9/02* (2006.01)
*E04C 3/02* (2006.01)

(58) Field of Classification Search
USPC ..... 52/167.1, 167.2, 167.3, 167.4, 167.7, 52/167.8
See application file for complete search history.

(56) References Cited

U.S. PATENT DOCUMENTS

| | | | | |
|---|---|---|---|---|
| 6,050,035 | A | 4/2000 | Thompson et al. | |
| 7,188,452 | B2 | 3/2007 | Sridhara | |
| 8,001,734 | B2 | 8/2011 | Pryor et al. | |
| 8,316,589 | B2 * | 11/2012 | Chou | E04H 9/02 52/167.1 |
| 8,375,652 | B2 | 2/2013 | Hiriyur et al. | |
| 8,397,444 | B2 | 3/2013 | Reaveley et al. | |
| 8,683,758 | B2 * | 4/2014 | Christopoulos | E04H 9/02 248/560 |
| 8,763,320 | B1 * | 7/2014 | Chou | E04B 1/98 52/167.3 |
| 2001/0000840 | A1 | 5/2001 | Takeuchi et al. | |
| 2003/0208970 | A1 | 11/2003 | Saelzer | |
| 2003/0222188 | A1 | 12/2003 | Smelser et al. | |
| 2011/0000155 | A1 | 1/2011 | Wellershoff | |
| 2012/0060432 | A1 | 3/2012 | Hulls et al. | |
| 2013/0074440 | A1 * | 3/2013 | Black | E04B 1/38 52/704 |
| 2013/0152490 | A1 | 6/2013 | Hinchman | |
| 2015/0000228 | A1 * | 1/2015 | Dusicka | E04C 3/00 52/835 |
| 2015/0184413 | A1 * | 7/2015 | Pryor | E04H 9/021 52/167.3 |

* cited by examiner

STRUCTURAL BRACES AND RELATED METHODS

CROSS-REFERENCE TO RELATED APPLICATIONS

This application claims the benefit of U.S. Provisional Patent Application Ser. No. 62/044,124, filed Aug. 29, 2014, and U.S. Provisional Patent Application Ser. No. 62/080,918, filed Nov. 17, 2014, the disclosures of each of which are hereby incorporated herein in their entirety by this reference.

TECHNICAL FIELD

Embodiments of the present disclosure relate to structural braces for building construction, to methods of forming such structural braces, and to methods of installing such structural braces in buildings.

BACKGROUND

Many structural systems are designed to resist deformation and damage by exhibiting high stiffness. High stiffness may allow a system to withstand applied forces without large amounts of associated movement by the system. However, high stiffness may also create a system having an increased risk of catastrophic failure when a threshold force is exceeded. Therefore, some structural systems are designed to have elasto-plastic deformation characteristics. For example, a system may exhibit substantially elastic deformation characteristics within a first range of applied forces. The removal of forces within that range can result in the system returning to an original state without significant changes to the system (i.e., without permanent deformation or damage). Forces applied in a second range that exceeds the first range (i.e., greater than a threshold force) may cause permanent, plastic deformation of the system. The plastic deformation regime may allow the system to dissipate significant amounts of energy without having to be excessively strong to resist a large force.

The elasto-plastic deformation may be thought of as a curve, such as that depicted in FIG. 1. FIG. 1 shows a graph 100 illustrating a relationship between the amount of force 102 applied and the amount of deformation 104 experienced by a structural system. The first range 106 of applied forces is shown having a substantially linear relationship with deformation. The second range 108 of applied force reflects a substantially linear relationship with deformation, but at a significantly reduced slope, and in some cases, an average slope of zero. The second range 108 depicts a plastic or ductile deformation regime in which the force applied deforms the system inelastically and the system dissipates energy.

While elasto-plastic structural systems have resulted in safer buildings and/or structures, they suffer from a number of drawbacks. For instance, damage to a structural system wrought by both excessive deformation and high accelerations result in repair costs that are very high given the cost of the structural system. Another problem in the design of such systems is the expense of designing a new structural system and/or retrofitting an existing structural system to reflect the desired deformation regimes. Conventional systems may require changes to the sizes of structural members of the system, changes to the type of connection between the structural members, changes to the distribution of structural members, or combinations thereof.

BRIEF SUMMARY

This summary is provided to introduce a selection of concepts that are further described below in the detailed description. This summary is not intended to identify specific features of the claimed subject matter, nor is it intended to be used as an aid in limiting the scope of the claimed subject matter.

In one aspect of the disclosure, a structural device includes a first deformable member configured to absorb at least a portion of a load resulting from relative displacement between structural members of a building. The first deformable member exhibits elastic deformation when subjected to tensile and/or compressive forces within a first range of forces and exhibits plastic deformation when subjected to tensile and/or compressive forces within a second range of forces. A second deformable member is affixed to a portion of the first deformable member and is configured to absorb at least another portion of the load resulting from the relative displacement between the structural members of the building. The second deformable member exhibits elastic deformation when subjected to tensile and/or compressive forces within a third range of forces and exhibits plastic deformation when subjected to tensile and/or compressive forces within a fourth range of forces. A threshold force level at a transition between the first range of forces and the second range of forces is less than a threshold force level at a transition between the third range of forces and the fourth range of forces.

In another aspect of the disclosure, a structural device includes a buckling restrained brace comprising a core having a first end and a second end, the core exhibiting elastic deformation when subjected to tensile and/or compressive forces within a first range of forces and exhibiting plastic deformation when subjected to tensile and/or compressive forces within a second range of forces. A body is disposed around the core, and a deformable layer is located between the body and the core. An auxiliary connector is affixed to an end of the core. The structural device includes a secondary deformable member having a first end and a second end, the first end affixed to the auxiliary connector and the second end affixed to the body of the buckling restrained brace. The secondary deformable member exhibits elastic deformation when subjected to tensile and/or compressive forces within a third range of forces and exhibits plastic deformation when subjected to tensile and/or compressive forces within a fourth range of forces.

In yet another aspect of the disclosure, a method of forming a structural device comprises configuring a buckling restrained brace to include a deformable core disposed within a body and to include at least one auxiliary connector at an end of the deformable core, configuring the deformable core to elastically deform when subjected to a tensile and/or compressive force in a first range of forces, configuring the deformable core to plastically deform when subjected to a tensile and/or compressive force in a second range of forces, attaching a deformable member between the body of the buckling restrained brace and the auxiliary connector, configuring the deformable member to elastically deform when subjected to a tensile and/or compressive force within a third range of forces, and configuring the deformable member to plastically deform when subjected to a tensile and/or compressive force in a fourth range of forces. A first threshold force between the first range of forces and the second range of forces is less than a second threshold force between the third range of forces and the fourth range of forces.

BRIEF DESCRIPTION OF THE DRAWINGS

In order to describe the manner in which the above-recited and other features of the disclosure can be obtained, a more particular description will be rendered by reference to specific embodiments thereof, which are illustrated in the appended drawings. Like elements may be designated by like reference numbers throughout the various accompanying figures. Understanding that the drawings depict some example embodiments, the embodiments will be described and explained with additional specificity and detail through the use of the accompanying drawings in which.

DETAILED DESCRIPTION

Example embodiments of the present disclosure are described below. The illustrations presented herein are not actual views of any particular device, but are merely idealized representations employed to describe embodiments of the present disclosure. Additionally, elements common between figures may retain the same numerical designation.

As used herein, the term "structural system" may mean or include one or more structural elements such as horizontal beams, vertical columns, etc. connected to form a structure, such as a frame of a building.

As used herein, the term "braced structural system" may mean or include a building frame including one or both of a buckling restrained brace and a secondary stiffness device.

The present disclosure relates to a braced structural system having the ability to manage excess input energy in a controlled manner to minimize damage to the braced structural system, and to devices that are easy to install for existing or new construction even under adverse field conditions, and which are usable in a variety of different applications and with many different construction materials. Embodiments of the disclosure may provide a braced structural system that responds elastically to smaller, more frequent earthquakes, and that may respond inelastically to a large earthquake without experiencing catastrophic damage to its components or contents.

One or more embodiments of the present disclosure may generally relate to constructing and installing secondary stiffness devices in structural systems. In at least one particular embodiment, a secondary stiffness device may be included in a buckling restrained brace. A secondary stiffness device may be included in a new structural system and/or an existing structural system that exhibits deformation characteristics that can be idealized as being elasto-plastic in nature. For example, a braced structural system may include buckling restrained braces to allow the braced structural system to deform according to a first deformation regime in which the structural system may deform elastically until a threshold force is applied. When a force greater than the threshold force is applied, the braced structural system may deform according to a second deformation regime in which the braced structural system deforms plastically to dissipate energy prior to reaching a specified level of deformation. In some cases, the specified level of deformation may be a catastrophic failure of the braced structural system. A braced structural system including a secondary stiffness device may exhibit a second elastic deformation regime and/or a second plastic deformation regime above a second threshold force at the upper limit of the first plastic deformation range.

Figure 1:
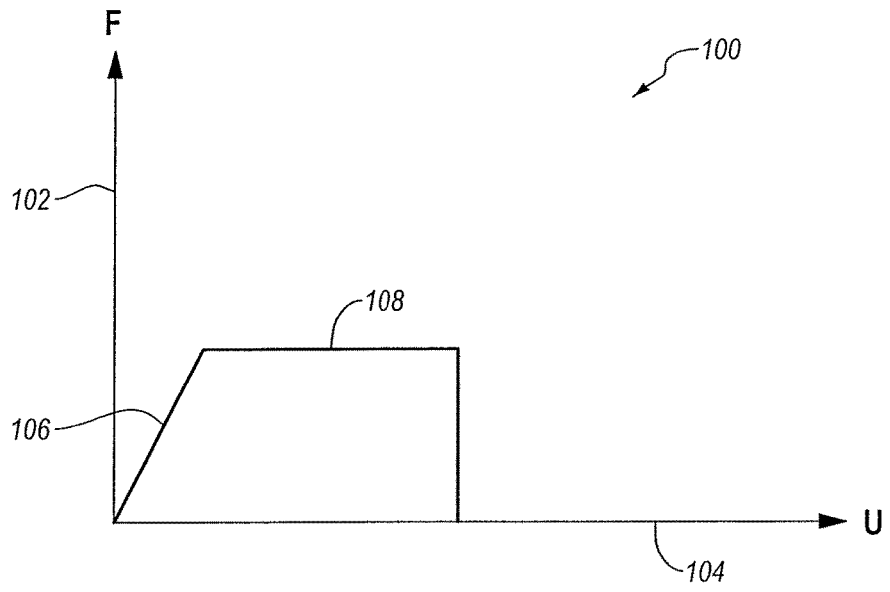
FIG. 1 is a graph relating force to deformation in a structural system exhibiting elasto-plastic deformation characteristics.
Figure 2:
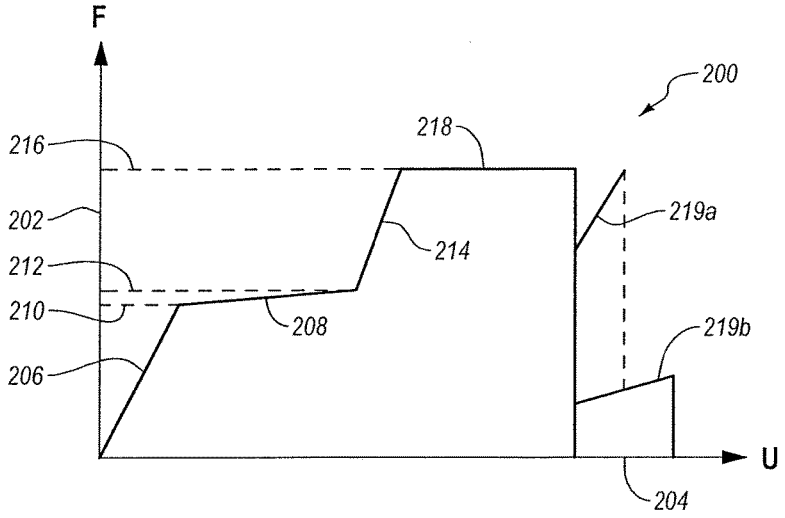
FIG. 2 is a graph relating force to deformation in a structural system including one or more secondary stiffness devices, according to one or more embodiments disclosed herein.

FIG. 2 is a graph 200 depicting an idealized response of a braced structural system including one or more secondary stiffness devices when exposed to a deforming force, such as seismic, wind, water, other external forces, or combinations thereof. The graph 200 depicts an idealized relationship between a force 202 applied to a braced structural system and the deformation 204 exhibited by the braced structural system. In contrast to the graph 100 in FIG. 1, the graph 200 in FIG. 2 depicts a braced structural system that exhibits a secondary stiffness regime.

The initial application of force to the braced structural system is shown in the first range 206 of forces in the graph 200. The first range 206 may exhibit an elastic response to the force 202 and the braced structural system may respond with substantially linear deformation 204. The second range 208 may exhibit a plastic response to the force 202 after a first threshold force 210 has been exceeded. The second range 208 may have a lesser slope than the first range 206, and in some instances, the second range 208 may have an average slope that is approximately or even at least substantially zero. Plastic deformation may allow for hysteresis in the deformation response of the braced structural system, which may dissipate energy in a controlled manner to reduce the chance of a catastrophic failure of the braced structural system.

The graph 200 also depicts a second threshold force 212 that may represent a transition to a second stiffness response enabled by one or more secondary stiffness devices in the braced structural system. For example, a third range 214 may once again exhibit a substantially linear and elastic response of deformation 204 to increased forces 202. The third range 214 may have a slope that is greater than the second range 208, reflecting the change in deformation response from at least substantially plastic deformation to at least substantially elastic deformation. After a third threshold force 216 is exceeded, the braced structural system having one or more secondary stiffness devices may exhibit a fourth range 218. The fourth range 218 may exhibit a second plastic deformation of the braced structural system, dissipating further energy in a controlled manner to reduce the chance of a catastrophic failure of the braced structural system. In some embodiments, a braced structural system including one or more secondary stiffness devices may exhibit a fifth range that may occur at greater deformation 204 than the described elasto-plastic behavior. For example, a braced structural system including one or more secondary stiffness devices may exhibit a failsafe compression mode 219*a* at greater deformation 204 than the described elasto-plastic behavior and up to similar forces as the fourth range 218. In another example, a braced structural system including one or more secondary stiffness devices exhibit a failsafe tension mode 219*b* at greater deformation 204 than the described elasto-plastic behavior and at forces less than or equal to the fourth range 218.

Figure 3:
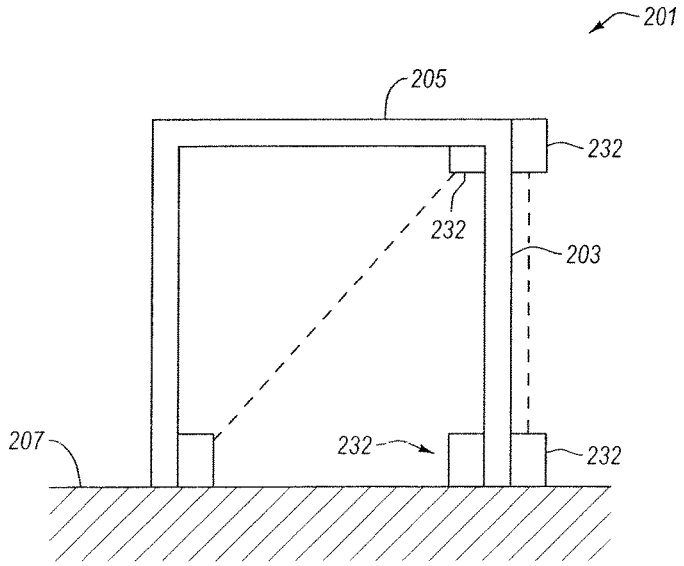
FIG. 3 is a schematic representation of a structural system having at least one secondary stiffness device exhibiting elasto-plastic deformation characteristics according to the graph of FIG. 2.

As shown in FIG. 3, a braced structural system 201 (which may be, for example, a frame of a building or other structure) exhibiting the deformation response characteristics depicted in FIG. 2 may allow one or more columns 203 and one or more beams 205 of the braced structural system 201 to elastically respond to lower forces (i.e., those forces below the first threshold force 210) without experiencing any substantial damage or permanent deformation to the braced structural system 201. Forces between the first threshold force 210 and the second threshold force 212 depicted in FIG. 2 may plastically deform the braced structural system 201 such that the braced structural system 201 experiences damage, but the braced structural system 201 remains sufficiently safe for persons inside the braced structural system 201. For example, the braced structural system 201 may experience damage to walls and frames of the braced structural system 201, but persons inside remain safe and may exit the structure after the loading event has passed. The braced structural system 201 may include a secondary stiffness device 232 located between various components of the braced structural system 201. For example, FIG. 3 shows a secondary stiffness device 232 located at the connection point of a column 203 and a base 207. In some embodiments, a secondary stiffness device 232 may be positioned at a connection point between a column 203 and a beam 205, cross-braces (not shown) between beams 205, cross-braces between columns 203, or between combinations thereof. In other embodiments, more than one secondary stiffness device 232 may be located at the connection point of the column 203 and the base 207 and positioned opposite of each other. In yet other embodiments, a plurality of secondary stiffness devices 232 may be located at other locations within the braced structural system 201, such as at the top of the column 203 adjacent the beam 205 and the base of the column 203.

A secondary stiffness device 232 may allow forces above the second threshold force 212 (FIG. 2) and below the third threshold force 216 (FIG. 2) to elastically deform the braced structural system 201 again without further permanent deformation of the braced structural system 201. The secondary stiffness devices 232 may allow forces equal to the third threshold force 216 to plastically deform the braced structural system 201 such that the braced structural system 201 experiences further damage but without a collapse of the braced structural system 201. For example, further damage to the braced structural system 201, such as fracturing of walls or damage to components of the system (i.e., electrical, mechanical, plumbing components) may be tolerated while a total collapse may lead to further damage to not only the braced structural system 201, but also to people and/or objects in the surrounding area. The first threshold force 210 (FIG. 2), the second threshold force 212, and the third threshold force 216 may be selected according to local building codes and the exposure of the structural system to various force loading events. For example, the desired upper and lower limits may be different for a region with higher seismicity, such as near an active fault line, when compared to a region with lower seismicity but greater wind exposure.

Figure 4:
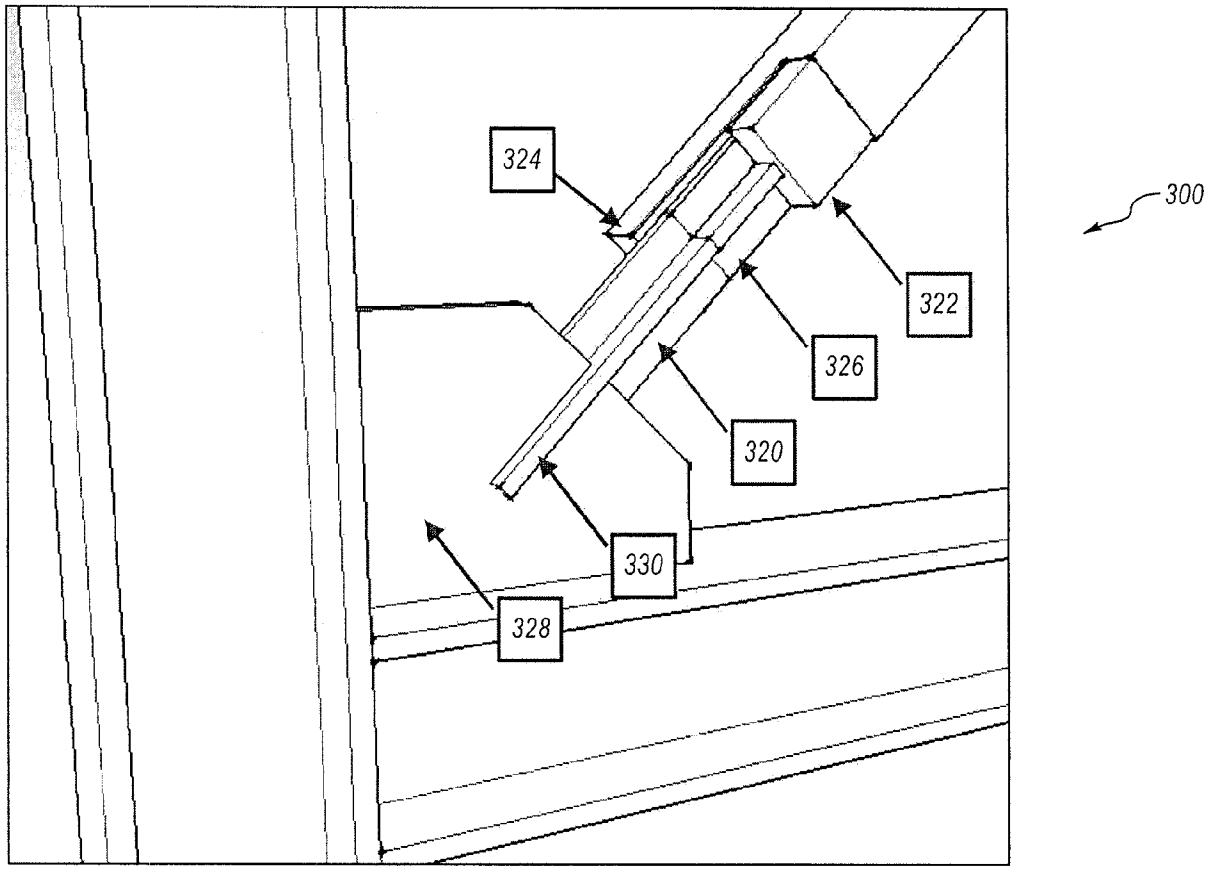
FIG. 4 is a perspective cutaway view of an embodiment of a buckling restrained brace that may exhibit elasto-plastic deformation characteristics.

An example of a braced structural system component that may allow a structural system to exhibit an elasto-plastic deformation response, such as the deformation response depicted in FIG. 1, is a buckling restrained brace. An embodiment of a buckling restrained brace 300 is depicted in FIG. 4. The buckling restrained brace 300 may be, for example, a buckling restrained brace substantially as described in U.S. Pat. No. 7,188,452, granted Mar. 13, 2007, to Sridhara, the disclosure of which is hereby incorporated herein in its entirety by this reference. The buckling restrained brace 300 may transmit tension and/or compression forces and may have a core 320 that runs continuously from a first joint in a structural system to a second joint in the structural system. The core 320 may be encased within a body 322, which, in turn, may be encased within a sleeve 324. The core 320 may be characterized as a core rod, or as a first deformable member. The core 320 and the body 322 may be separated by a deformable layer 326 between the core 320 and the body 322. The deformable layer 326 may deform plastically and allow the core 320 and the body 322 to move relative to one another within the sleeve 324. In some embodiments, deformable layer 326 may include a material that has a lower hardness than the core 320 and/or the body 322. In at least one embodiment, the deformable layer 326 may be a void or air gap between the core 320 and the body 322.

The core 320 may be made from any suitable ductile material, such as a metal. The metal may have various compositions such as a steel alloy, titanium alloy, aluminum alloy, superalloy, other alloy, or a combination thereof. In some embodiments, the steel alloy may include alloying elements such as a carbon, manganese, nickel, chromium, molybdenum, tungsten, vanadium, silicon, boron, lead, other appropriate alloying elements, or combinations thereof. In some embodiments, the titanium alloy may include alloying elements such as aluminum, vanadium, palladium, nickel, molybdenum, ruthenium, niobium, silicon, oxygen, iron, other appropriate alloying elements, or combinations thereof In some embodiments, the aluminum alloy may include alloying elements such as silicon, iron, copper, manganese, magnesium, chromium, zinc, vanadium, titanium, bismuth, gallium, lead, zircon, other appropriate alloying elements, or combinations thereof. In some embodiments, the superalloy may include elements such as nickel, cobalt, iron, chromium, molybdenum, tungsten, tantalum, aluminum, titanium, zirconium, rhenium, yttrium, boron, carbon, another appropriate alloying element, or combinations thereof.

The body 322 may comprise a material that exhibits relatively high strength in compression and/or tension. As a non-limiting example, the body 322 may comprise concrete or cement. For example, the body 322 may include a concrete mixture to provide the body 322 with high compressive strength. The body 322 material may have a low toughness value when compared to the core 320 material (i.e., the body 322 may be more brittle than the core 320). The deformable layer 326 located between the body 322 and the core 320 may allow for at least some relative longitudinal movement between the body 322 and the core 320.

The deformable layer 326 essentially causes the buckling restrained brace to behave as if a void were present around the core 320 between the core 320 and the body 322. The core 320 and the body 322, therefore, may not be bonded to one another at any point along a length of the buckling restrained brace 300. The deformable layer 326 may allow the core 320 and the body 322 to move relative to one another according to the ductility of the deformable layer 326. In some embodiments, the material and thickness of the deformable layer 326 may be selected to "tune" the relative movement between the core 320 and the body 322 of the buckling restrained brace 300. In some embodiments, the potential plastic deformation of the core 320 is the distance between the body 322 and a gusset plate 328.

While the core 320 may run continuously from a first joint in a braced structural system to a second joint in the structural system, the body 322 and the sleeve 326 around the body 322 may not be continuous along the length of the buckling restrained brace 300. In at least one embodiment, the body 322 and sleeve 326 may not be connected at either end to a column and/or beam of the structural system. The core 320 may extend beyond the body 322 and sleeve 326. The core 320 may be connected to the beam/column joint directly or at a gusset plate 328 connected to the beam/column joint, such as is depicted in FIG. 4. A connection portion 330 of the core 320 may extend to and/or past the gusset plate 328 or beam/column joint such that the core 320 may be connected to the structural system. In some embodiments, the connection portion 330 may be welded, fused, or otherwise bonded to the remainder of the structural system. In other embodiments, the connection portion 330 may be bolted, pinned, or otherwise mechanically connected to the remainder of the structural system. In yet other embodiments, the connection portion 330 may be connected to the remainder of the structural system by a combination of the aforementioned connections. The core 320 may be configured to elastically and/or plastically deform to absorb a load resulting from relative displacement between structural members of a building.

Figure 5:
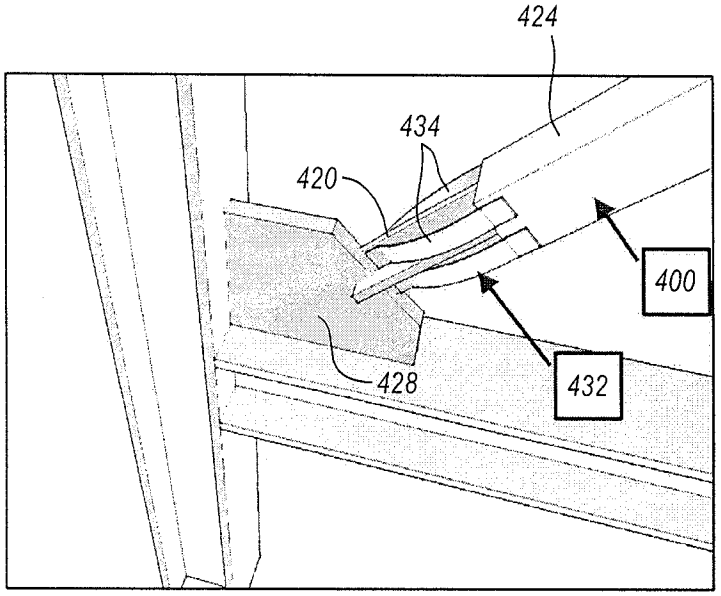
FIG. 5 is a perspective view of a buckling restrained brace having a secondary stiffness device that may provide secondary stiffness under tension, according to one or more embodiments disclosed herein.

FIG. 5 depicts a buckling restrained brace 400 having an embodiment of a secondary stiffness device 432 affixed thereto. The secondary stiffness device 432 may be characterized as a second deformable member. The buckling restrained brace 400 may be similar to or the same as the buckling restrained brace 300 depicted in FIG. 4. The buckling restrained brace 400 may have a sleeve 424 that forms an outer surface of the buckling restrained brace 400. The sleeve 424 may be rectangular or elliptical in transverse cross-section, or the sleeve 424 may have another closed shape in transverse cross-section, such as a round cross-sectional shape. In some embodiments, the secondary stiffness device 432 may include one or more deformation members, such as strap members 434, which connect the sleeve 424 to a core 420 of the buckling restrained brace 400. In other embodiments, the strap members 434 may connect the sleeve 424 to a gusset plate 428 or other component of the structural system.

The strap members 434 may comprise a bent plate of metal, such as any of the metals described in relation to the core 320 in FIG. 4. The bent plate strap members may include a plate of metal formed with a particular deviation from a straight line. In other words, the strap members 434 may have a curved profile. The greater the deviation from a straight line, the greater the displacement may be for a given applied force. The strap members 434 may therefor allow for a secondary stiffness regime (i.e., the third range 214 of forces in FIG. 2) after a second threshold force has been exceeded. The strap members 434 may work in concert with the buckling restrained brace 400 to dissipate energy during deformation of the structural system after the buckling restrained brace 400 has entered a ductile deformation regime.

For example, the buckling restrained brace 400 may deform elastically by elastic deformation of the core 420 attached at either end of the buckling restrained brace 400. When the yield strength of the core 420 is exceeded and the buckling restrained brace 400 begins to deform plastically, the strap members 434 may engage. The strap members 434 may deform elastically providing a second range of elastic behavior. When the strap members 434 are straight and under tension substantially exclusively, the strap members 434 may begin to deform plastically, providing the second range of plastic behavior. The second range of plastic behavior may allow a structural system to dissipate further energy prior to a catastrophic failure. When strap members 434 experience tension forces, the strap members 434 may exert a restoring force in opposition to the tension force. The restoring force may act to pull the buckling restrained brace 400 toward an original undeformed state. For example, if the strap members 434 experience only elastic deformation without plastic deformations, the strap members 434 may apply the restoring force toward a state at which the straps had initially engaged.

Figure 6:
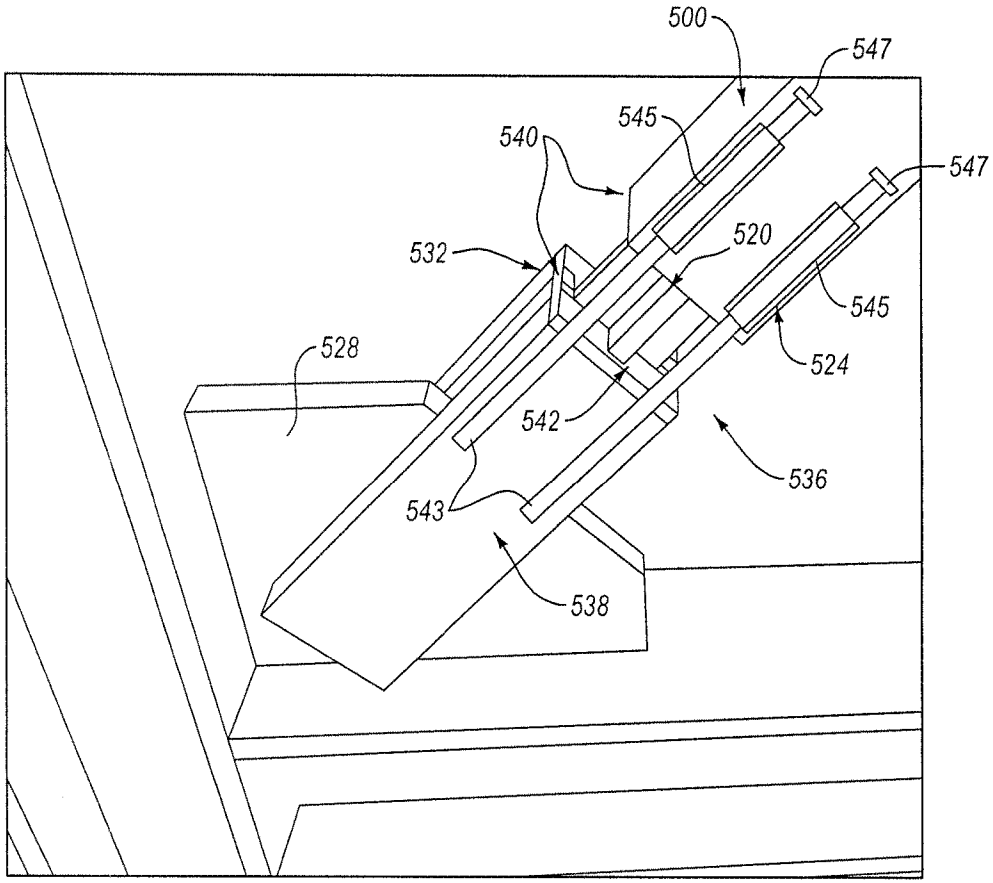
FIG. 6 is a perspective view of a buckling restrained brace having a secondary stiffness device that may provide secondary stiffness under compression, according to one or more embodiments disclosed herein.

FIG. 6 depicts another embodiment of an SDD 532 applied to a buckling restrained brace 500. A structural system that includes a buckling restrained brace 500 may experience compression loads. The buckling restrained brace 500 may exhibit an elasto-plastic deformation by elastic deformation of a core 520 attached to the structural system at either end of the buckling restrained brace 500. When the yield strength of the core 520 is exceeded by the applied force, the core 520 may deform plastically. During plastic deformation, a body (not shown) and sleeve 524 may move relative the core 520. The buckling restrained brace 500 may include a gap 536 between the sleeve 524 and an auxiliary connector 538 affixed to a joint and/or gusset plate 528 of the structural system and arranged to transfer force to the joint and/or gusset plate 528. The auxiliary connector 538 may be connected to the joint and/or gusset plate 528 by any appropriate connection type such that the auxiliary connector 538 may provide a surface upon which a compression plate 540 may be compressed. For example, the auxiliary connector 538 may be an auxiliary weldment arranged to be welded to the joint and/or gusset plate 528. The auxiliary connector 538 may also be riveted, screwed, adhered, brazed, or mechanically hooked to the joint and/or gusset plate 528. The auxiliary connector 538 may comprise steel, aluminum, titanium or other metal alloys described herein. The auxiliary connector 538 may comprise channels, plates, tubes, or combinations thereof.

The gap 536 may provide a length through which the buckling restrained brace 500 may be displaced during plastic deformation of the core 520 before the sleeve 524 (and associated body encased therein) contacts the auxiliary connector 538. The secondary stiffness device 532 may include one or more compression plates 540 located between the sleeve 524 (and associated body) and the auxiliary connector 538. As shown in FIG. 6, in at least one embodiment, the secondary stiffness device 532 may include a pair of compression plates 540 affixed to the sleeve 524 (and associated body) and the auxiliary connector 538, respectively, and substantially opposing one another. At least one of the compression plates 540 may have an opening 542 disposed therethrough, such that the compression plates 540 may allow the core 520 to pass through the compression plates 540.

The compression plates 540 may contact one another after the core 520 has deformed such that the sleeve 524 has moved relative to the auxiliary connector 538 a distance equal to the gap 536. One or more of the compression plates 540 may have a surface layer of elastomeric material that may compress as the plates come together. The elastomeric material may lessen the impact of compression plates 540 and provide additional elastic behavior. The compression plates 540 may engage and provide a second elastic deformation response under compression. The second elastic deformation response may allow the structural system to withstand forces exceeding the plastic deformation range of the buckling restrained brace 500 without further damage to the structural system. As the compression force increases, the force on the compression plates 540 and the auxiliary connector 538 may exceed the rated capacity of the buckling restrained brace 500. The force will reach the full compressive capacity of the concrete filled sleeve 524. The auxiliary connector 538 may provide additional buckling resistance for the core 520 and the buckling restrained brace 500 as a whole.

In some embodiments, the secondary stiffness device 532 may include one or more stabilization members 543. In some embodiments, one or more stabilization members 543 may comprise steel, aluminum, titanium or other metal alloys described herein. One or more stabilization members 543 may extend from the auxiliary connector 538 to the sleeve 524. One or more stabilization members 543 may be located on any side of, or a combination of sides of, the auxiliary connector 538 and/or sleeve 524. At least one of the one or more stabilization members 543 may be fixed relative to the auxiliary connector 538 or the sleeve 524. For example, in the embodiment shown in FIG. 6, the stabilization members 543 are fixed relative to the auxiliary connector 538 and movable relative to the sleeve 524. The one or more stabilization members 543 may be fixed relative to the auxiliary connector 538 or sleeve 524 by welding, brazing, adhesive, mechanical connectors, or combinations thereof. The auxiliary connector 538 or sleeve 524 relative to which the one or more stabilization members 543 may move may have a channel 545 fixed to a surface thereof and configured to direct movement of the one or more stabilization members 543. For example, FIG. 6 depicts a channel 545 fixed relative to the sleeve 524 and configured to allow a stabilization member 543 to move longitudinally therethrough during compression and/or tension of the secondary stiffness device 532. In some embodiments, one or more stabilization members 543 may provide at least some lateral stabilization of the buckling restrained brace 500 against lateral movement and/or buckling during compression and/or tension of the buckling restrained brace 500. In other embodiments, the one or more stabilization members 543 may provide at least some torsional stabilization of the buckling restrained brace 500 against rotational movement and/or buckling.

The secondary stiffness device 532 may include one or more endplates 547 configured to contact the one or more stabilization members 543 during compression of the secondary stiffness device 532. The one or more endplates 547 may comprise steel, aluminum, titanium or other metal alloys described herein. The one or more endplates 547 may be fixed to the sleeve 524 and/or the auxiliary connector 538 by welding, brazing, adhesive, mechanical connectors, or combinations thereof. In some embodiments, the one or more endplates 547 may be positioned to limit the movement of one or more stabilization members 543 to a distance greater than or equal to the length of the gap 536. In other embodiments, the one or more endplates 547 may be positioned to limit the movement of one or more stabilization members 543 to a distance equal to or less than the length of the gap 536.

Figure 7:
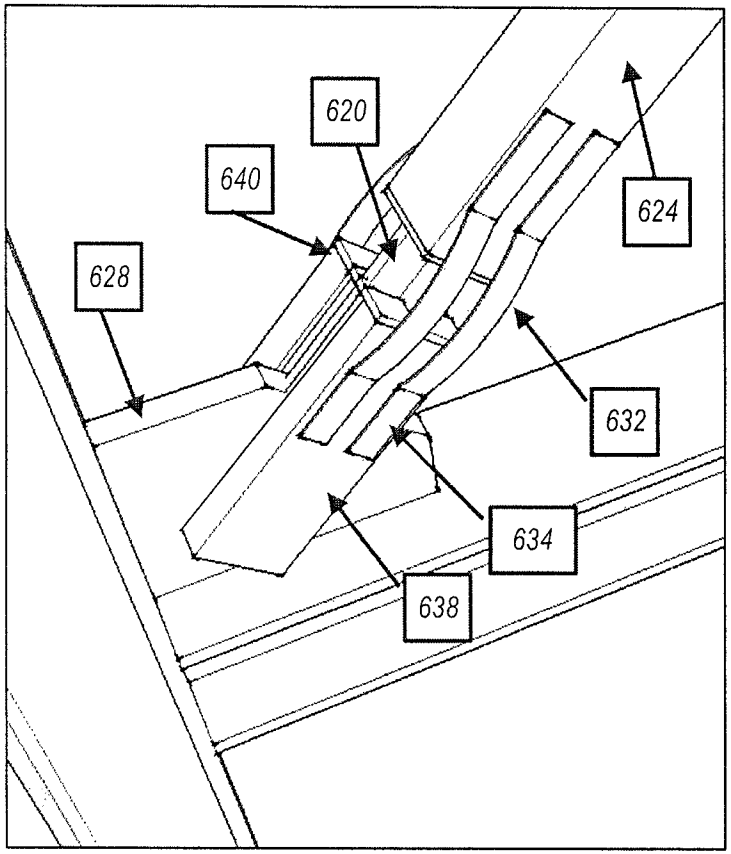
FIG. 7 is a perspective view of a buckling restrained brace having a secondary stiffness device that may provide secondary stiffness under tension and compression, according to one or more embodiments disclosed herein.

As shown in FIG. 7, a buckling restrained brace 600 may include a secondary stiffness device 632 that may allow for secondary stiffness under both tension and compression. In some embodiments, a secondary stiffness device 632 may include both strap members 634 and compression plates 640 and an auxiliary connector 638. The strap members 634 may be welded, fused, bolted, otherwise affixed, or connected by combinations thereof to the sleeve 624 and the auxiliary connector 638 and/or gusset plate 628. The strap members 634 may be similar to those described in connection with FIG. 5. The secondary stiffness device 632 may include one or more strap members 634 on each side of the sleeve 624 and the auxiliary connector 638 and/or gusset plate 628. For example, FIG. 7 depicts two strap members 634 on opposing sides of the sleeve 624 and the auxiliary connector 638 and/or gusset plate 628. In another example, a buckling restrained brace 600 may have two strap members 634 on each of four sides of the sleeve 624 and the auxiliary connector 638 and/or gusset plate 628.

The secondary stiffness device 632 may also include one or more compression plates 640 located about a core 620 and at least partially between the sleeve 624 and the auxiliary connector 638. Under tension, the deformation characteristics of the core 620 and body (not shown) encased in the sleeve 624 may provide a first elastic deformation range and first plastic deformation range until the strap members 634 engage and provide a second elastic deformation range and second plastic deformation range. Under compression, the deformation characteristics of the core 620 and body (not shown) encased in the sleeve 624 may provide a first elastic deformation range and first plastic deformation range until the one or more compression plates 640 engage and the compression plates 640 and auxiliary connector 638 provide a second elastic deformation range and second plastic deformation range. In some embodiments, the strap members 634 may also contribute to an elastic and/or plastic deformation characteristic under compression, as well.

Figure 8:
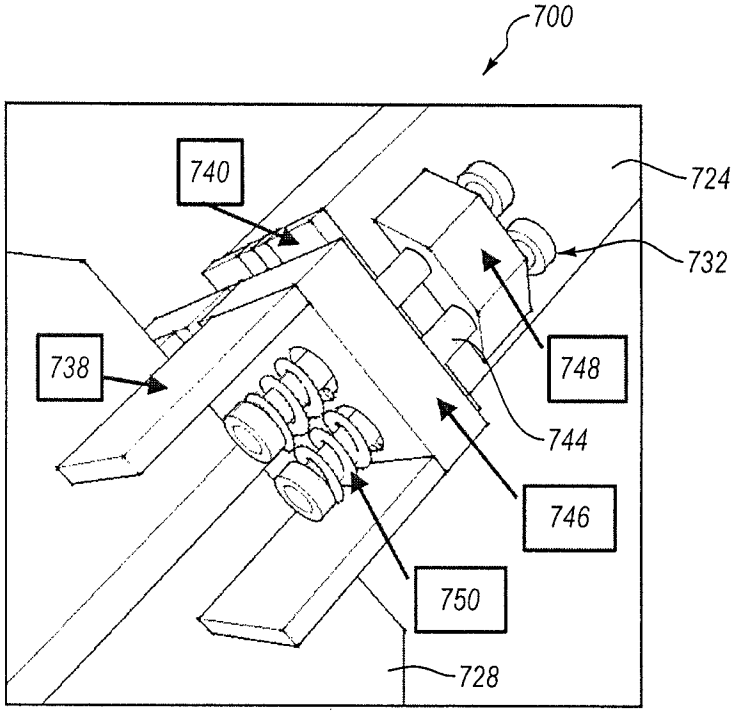
FIG. 8 is a perspective view of a buckling restrained brace having a secondary stiffness device including tension bolts that may provide secondary stiffness under tension and compression, according to other embodiments disclosed herein.

FIG. 8 illustrates another embodiment of a buckling restrained brace 700 including a secondary stiffness device 732 that may provide secondary stiffness during compression and/or tension. In the depicted embodiment, the secondary stiffness device 732 may include one or more tension bolts 744 that connect from the sleeve 724 to the joint and/or the gusset plate 728. In some embodiments, the one or more tension bolts 744 may extend from an auxiliary connector 738 connected to the joint and/or gusset plate 728 to a lateral extension 748 protruding from and/or connected to the sleeve 724. The lateral extension 748 may be characterized as a tension bolt mounting plate. In some embodiments, the one or more tension bolts 744 may extend through a top plate 746 in the auxiliary connector 738 and may be longitudinally spaced from the top plate 746 by one or more resilient members, such as springs 750 or elastomeric layers. The resilient members may allow the tension bolts 744 to move elastically during and/or after plastic deformation of a core (not shown) of the buckling restrained brace 700. For example, after a threshold force of the core has been exceeded, the core may deform plastically and the sleeve 724 may move away from the joint and/or gusset plate 728. The tension bolts 744 may apply a force between the lateral extension 748 of the sleeve 724 and the top plate 746 of the auxiliary connector 738. The force applied by the tension bolts 744 may exhibit elastic deformation characteristics as the resilient member elastically deforms. (The springs 750 of the secondary stiffness device 732 depicted in FIG. 8 may be thought of as analogous to the leaf spring-like strap members depicted in FIGS. 4 and 6.) The tension bolts 744 may elastically deform and then also provide a secondary plastic deformation characteristic as force increases. Once another threshold force has been exceeded, the resilient members may be compressed between the top plate 746 and an end of a tension bolt 744. The tension bolt 744 may elastically deform and then plastically deform providing a secondary plastic deformation range for the secondary stiffness device 732. The springs 750 may provide inelastic buckling stability to the tension bolts 744.

Figure 9:
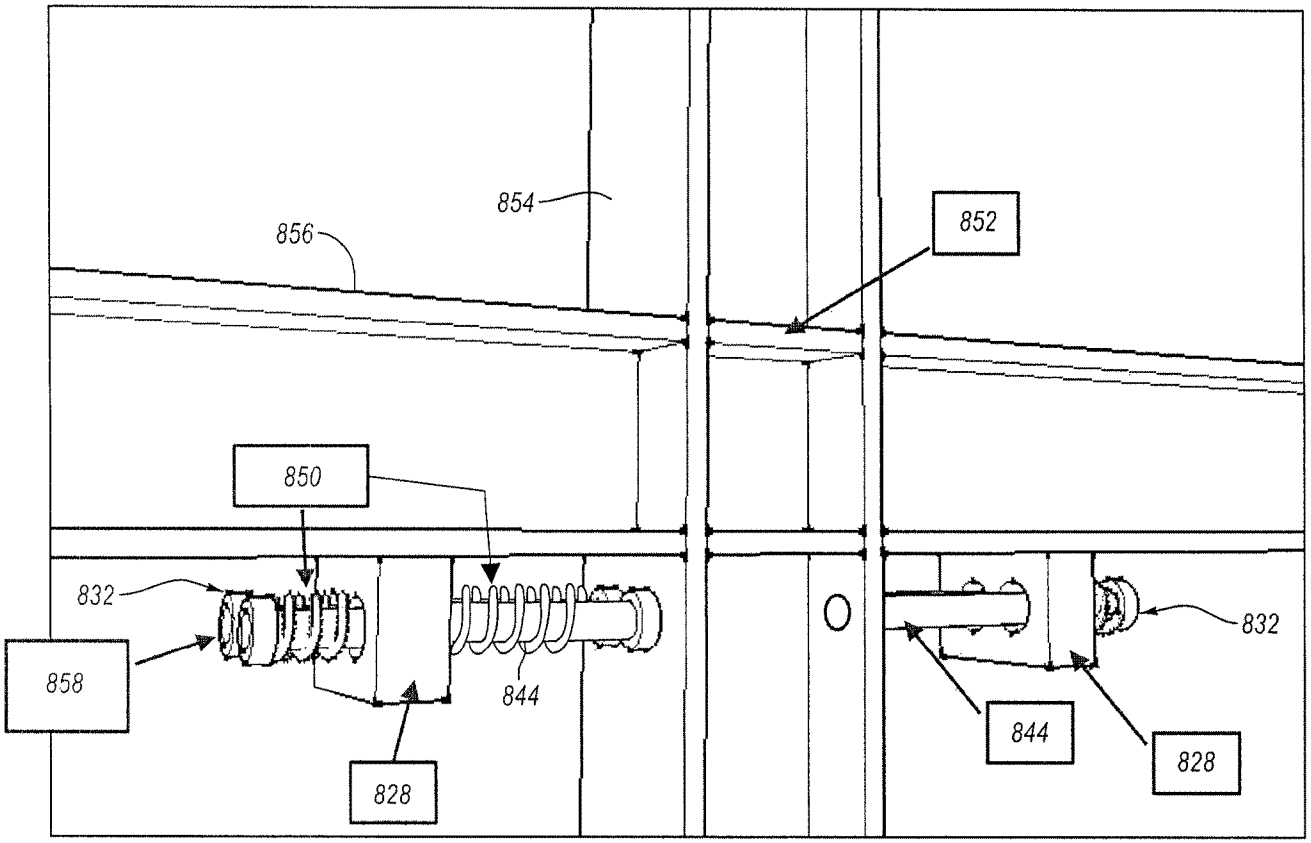
FIG. 9 is a perspective view of a horizontal steel beam and a vertical column junction including a secondary stiffness device applied to the beam, according to one or more embodiments disclosed herein.

Yet another embodiment of a secondary stiffness device 832 is depicted in FIG. 9. The secondary stiffness device 832 shown in FIG. 9 is connected directly to a beam column joint 852. It should be understood that while FIG. 9 depicts a plurality of secondary stiffness devices 832 aligned horizontally along a beam 856 adjacent a column 854, the same configuration may be applied rotated 90 degrees. For example, one or more secondary stiffness devices 832 may be affixed vertically to a column 854 and arranged to apply force to a beam 856 using a substantially similar configuration as depicted and described in relation to FIG. 9. In other embodiments, the column 854 and/or beam 856 may comprise various materials. For example, the column 854 and/or beam 856 may include and/or be made of metal, metal alloys, wood, concrete, cement, brick, stone, plastics, composites, other suitable construction materials, or combinations thereof.

In some embodiments, the secondary stiffness device 832 may include a tension bolt 844 disposed through an auxiliary connector 828. The tension bolt 844 may be made from or include any material that exhibits a ductile response, including at least some of the metals described in relation to FIG. 4. The tension bolt 844 may be round/elliptical in transverse cross-section or may have a polygonal transverse cross-section. The auxiliary connector 828 may be welded, fused, adhered, bolted, or otherwise connected to the beam 856 such that the auxiliary connector 828 is substantially fixed relative to the beam 856. Tension bolts 844 may be in contact with and/or be connected with the column 854 and with resilient members 850 that apply a force between a bolt head 858 and the auxiliary connector 828. The resilient members 850 may comprise any material that exhibits an elastic response, including at least some of the metals described in relation to FIG. 4. The resilient members 850 may occur on each side of the auxiliary connector 828 and engage the tension bolt 844 along a length thereof, and in some cases, along a full length thereof. In some embodiments, the tension bolts 844 may extend through the column 854 to an opposing side of the column 854. In other embodiments, the tension bolts 844 may extend from the auxiliary connector 828 through the column 854 to an auxiliary connector 828 affixed to the beam 856 on an opposing side of the column 854. The auxiliary connector 828 may be located adjacent or proximate a column 854, or may be located up to 30 feet away from the column 854. The resilient members 850 may provide a secondary elastic deformation characteristic to a braced structural system while the tension bolts 844 may provide a secondary elastic and plastic deformation characteristic.

A secondary stiffness device according to the present disclosure may be applied to existing structures and/or new building designs. While embodiments have been described in this disclosure including secondary stiffness devices applied to systems to provide a secondary stiffness response, secondary stiffness devices may be applied in series to achieve a combined effect to provide a tertiary stiffness response. For example, a secondary stiffness device may connect a buckling restrained brace to a gusset plate, as described in relation to FIG. 7. The gusset plate may be additionally connected to a structural joint, such as a beam column joint, by another secondary stiffness device to provide a tertiary stiffness response. Additional secondary stiffness devices may be configured to engage at predetermined amounts of deformation.

Figure 10:
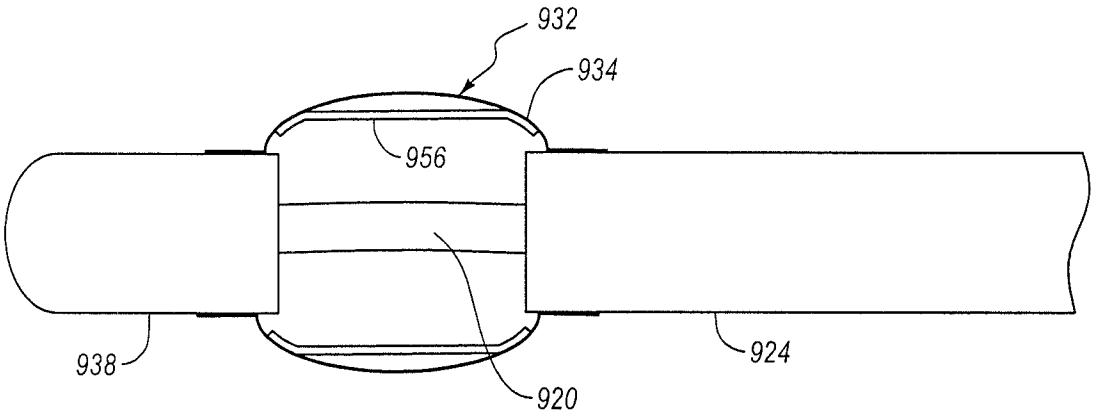
FIG. 10 is a side view of a buckling restrained brace having a secondary stiffness device with a plurality of sets of strap members that may provide secondary stiffness and tertiary stiffness under tension, according to one or more embodiments disclosed herein.

Referring now to FIG. 10, in another embodiment, the secondary stiffness device 932 may be arranged to provide plastic deformation of some parts of the secondary stiffness device 932 while other parts of the secondary stiffness device 932 provide elastic deformation. For example, a secondary stiffness device 932 including strap members 934 may include reinforcement members 956. The strap members 934 may connect a sleeve 924 to an auxiliary connector 938 similarly to the structure described in relation to FIG. 7. The strap members 934 may have reinforcement members 956 connected thereto such that the reinforcement members 956 engage and begin to elastically deform after plastic deformation of a core 920, but before the strap members 934 engage. The reinforcement members 956 may deform elastically until a threshold force is exceeded, at which point, the reinforcement members 956 will begin to plastically deform as the strap members 934 engage and elastically deform. The reinforcement member 956 may, therefore, extend the effective range of forces over which the secondary stiffness device 932 may dissipate energy.

Figure 11:
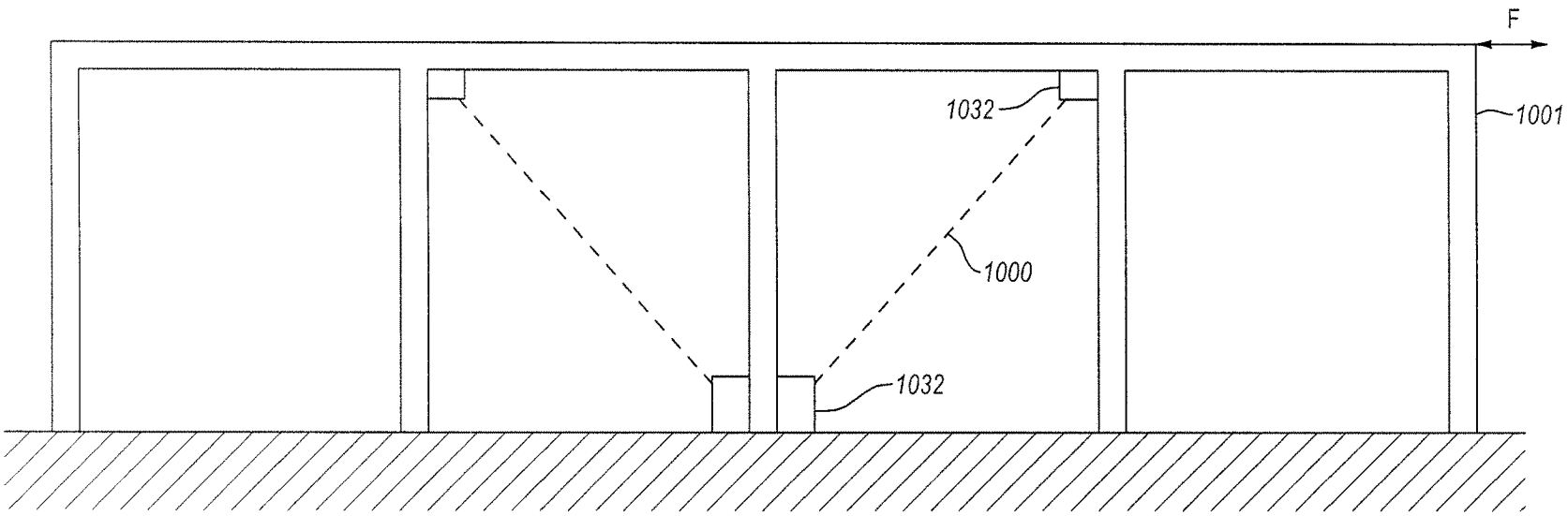
FIG. 11 is a schematic representation of a multiple frame structure that has two buckling restrained braces including at least one secondary stiffness device in each, one buckling restrained brace in each of two different bays.

FIG. 11 illustrates a braced structural system 1001 that includes a plurality of buckling restrained braces 1000. At least one of the buckling restrained braces 1000 comprises a secondary stiffness device 1032. The buckling restrained braces 1000 may be connected to the braced structural system 1001 in a variety of orientations. In some embodiments, the distribution of orientations of the buckling restrained braces 1000 may provide at least one buckling restrained brace 1000 that is oriented to experience a compressive force. In other embodiments, the distribution of orientations of the buckling restrained braces 1000 may provide at least one buckling restrained brace 1000 that is oriented to experience a tension force. In yet other embodiments, the distribution of orientations of the buckling restrained braces 1000 may provide at least one buckling restrained brace 1000 that is oriented to experience a tension force and at least one buckling restrained brace 1000 that is oriented to experience a compressive force.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

Additional non-limiting example embodiments of the disclosure are set forth below.

Embodiment 1: A structural device, comprising: a first deformable member configured to absorb at least a portion of a load resulting from relative displacement between structural members of a building, the first deformable member exhibiting elastic deformation when subjected to tensile and/or compressive forces within a first range of forces and exhibiting plastic deformation when subjected to tensile and/or compressive forces within a second range of forces; and a second deformable member affixed to a portion of the first deformable member and configured to absorb at least another portion of the load resulting from the relative displacement between the structural members of the building, the second deformable member exhibiting elastic deformation when subjected to tensile and/or compressive forces within a third range of forces and exhibiting plastic deformation when subjected to tensile and/or compressive forces within a fourth range of forces, wherein a threshold force level at a transition between the first range of forces and the second range of forces is less than a threshold force level at a transition between the third range of forces and the fourth range of forces.

Embodiment 2: The structural device of Embodiment 1, wherein the structural device is a buckling restrained brace, and wherein the first deformable member comprises a core rod of the buckling restrained brace.

Embodiment 3: The structural device of Embodiment 2, wherein the buckling restrained brace comprises a body surrounding the core rod.

Embodiment 4: The structural device of Embodiment 3, wherein the buckling restrained brace comprises one or more auxiliary connectors configured to couple first and second ends of the core rod to the structural members of the building.

Embodiment 5: The structural device of Embodiment 4, wherein the second deformable member comprises at least one tension strap fixed between one of the one or more auxiliary connectors and the body of the buckling restrained brace.

Embodiment 6: The structural device of Embodiment 4, wherein the second deformable member comprises at least one tension bolt disposed between the one of the one or more auxiliary connectors and the body of the buckling restrained brace.

Embodiment 7: The structural device of Embodiment 6, further comprising an elastic member disposed between a head of the at least one tension bolt and a tension bolt mounting plate of one of the auxiliary connector and the body of the buckling restrained brace.

Embodiment 8: The structural device of Embodiment 7, wherein the elastic member is configured to elastically deform during plastic deformation of the first deformable member.

Embodiment 9: The structural device of any one of Embodiments 1 through 8, further comprising at least one compression plate located between one of the one or more auxiliary connectors and the body of the buckling restrained brace.

Embodiment 10: The structural device of Embodiment 9, wherein the at least one compression plate comprises an opening through which the core rod passes.

Embodiment 11: The structural device of Embodiment 9 or Embodiment 10, wherein the at least one compression plate comprises a first compression plate affixed to the body of the buckling restrained brace, and a second compression plate affixed to the one of the one or more auxiliary connectors.

Embodiment 12: The structural device of Embodiment 11, further comprising an elastomeric material disposed between the first compression plate and the second compression plate.

Embodiment 13: The structural device of Embodiment 12, wherein the elastomeric material is configured to elastically deform under a compressive load between the one of the one or more auxiliary connectors and the body of the buckling restrained brace.

Embodiment 14: The structural device of any one of Embodiments 4 through 13, further comprising one or more stabilization members connected between one of the one or more auxiliary connectors and the body of the buckling restrained brace.

Embodiment 15: The structural device of Embodiment 14, wherein the one or more stabilization members each comprise a rod connected to the auxiliary connector, the rod extending through a channel affixed to the body of the buckling restrained brace.

Embodiment 16: A structural device, comprising: a buckling restrained brace comprising: a core having a first end and a second end, the core exhibiting elastic deformation when subjected to tensile and/or compressive forces within a first range of forces and exhibiting plastic deformation when subjected to tensile and/or compressive forces within a second range of forces; a body disposed around the core; a deformable layer located between the body and the core; and an auxiliary connector affixed to an end of the core; and a secondary deformable member having a first end and a second end, the first end affixed to the auxiliary connector and the second end affixed to the body of the buckling restrained brace, the secondary deformable member exhibiting elastic deformation when subjected to tensile and/or compressive forces within a third range of forces and exhibiting plastic deformation when subjected to tensile and/or compressive forces within a fourth range of forces.

Embodiment 17: The structural device of Embodiment 16, wherein a first threshold force between the first range of forces and the second range of forces is less than a second threshold force between the third range of forces and the fourth range of forces.

Embodiment 18: The structural device of Embodiment 16 or Embodiment 17, wherein the secondary deformable member comprises a metal strap affixed to the body of the buckling restrained brace and to the auxiliary connector.

Embodiment 19: The structural device of any one of Embodiments 16 through 18, wherein the metal strap has a curved profile.

Embodiment 20: A method of forming a structural device, the method comprising: configuring a buckling restrained brace to include a deformable core disposed within a body and to include at least one auxiliary connector at an end of the deformable core; configuring the deformable core to elastically deform when subjected to a tensile and/or compressive force in a first range of forces; configuring the deformable core to plastically deform when subjected to a tensile and/or compressive force in a second range of forces; attaching a deformable member between the body of the buckling restrained brace and the auxiliary connector; configuring the deformable member to elastically deform when subjected to a tensile and/or compressive force within a third range of forces; and configuring the deformable member to plastically deform when subjected to a tensile and/or compressive force in a fourth range of forces, wherein a first threshold force between the first range of forces and the second range of forces is less than a second threshold force between the third range of forces and the fourth range of forces.

Although the foregoing description and accompanying drawings contain many specifics, these are not to be construed as limiting the scope of the disclosure, but merely as describing certain embodiments. Similarly, other embodiments may be devised, which do not depart from the spirit or scope of the disclosure. For example, features described herein with reference to one embodiment also may be provided in others of the embodiments described herein. The scope of the invention is, therefore, indicated and limited only by the appended claims and their legal equivalents. All additions, deletions, and modifications to the disclosed embodiments, which fall within the meaning and scope of the claims, are encompassed by the present disclosure.

What is claimed is:

1. A structural device, comprising:

a first deformable member that, when subjected to axial tensile forces resulting from relative displacement between structural members of a building, absorbs at least a portion of a load resulting from the relative displacement between the structural members of the building, the first deformable member exhibiting elastic deformation when subjected to axial tensile forces within a first range of forces and exhibiting plastic deformation when subjected to axial tensile forces within a second range of forces, wherein the first deformable member has a first threshold force level at a transition between the first range of forces and the second range of forces; and a second deformable member that, when subjected to axial tensile forces resulting from the relative displacement between the structural members of the building, absorbs at least another portion of the load resulting from the relative displacement between the structural members of the building, the second deformable member exhibiting elastic deformation when subjected to axial tensile forces within a third range of forces and exhibiting plastic deformation when subjected to axial tensile forces within a fourth range of forces, wherein the second deformable member has a second threshold force level at a transition between the third range of forces and the fourth range of forces, wherein the first threshold force level is less than the second threshold force level, the second deformable member comprising one or more strap members connected between a first portion of the first deformable member and a second portion of the first deformable member.

2. The structural device of claim 1, wherein the first deformable member comprises a core rod, the core rod being a continuous member that extends between and has opposing ends of which are connected directly to the structural members of the building.

3. The structural device of claim 2, wherein the first deformable member further comprises a body surrounding and enclosing a substantial portion of the core rod.

4. The structural device of claim 3, further comprising one or more auxiliary connectors configured to couple first and second ends of the core rod to the structural members of the building.

5. The structural device of claim 4, wherein the one or more straps members are connected between one of the one or more auxiliary connectors and the body of the first deformable member.

6. The structural device of claim 3, wherein the one or more strap members are connected between the core rod and the body of the first deformable member.

7. The structural device of claim 4, further comprising at least one compression plate located between one of the one or more auxiliary connectors and the body of the first deformable member.

8. The structural device of claim 7, wherein the at least one compression plate comprises an opening through which the core rod passes.

9. The structural device of claim 1, wherein at least one of the one or more strap members comprises a bent plate having a predetermined deviation from a straight line.

10. The structural device of claim 9, wherein the bent plate comprises a curved profile.

11. A structural device, comprising:

a first deformable member that, when subjected to compressive forces resulting from relative displacement between structural members of a building, absorbs at least a portion of a load resulting from the relative displacement between the structural members of the building, the first deformable member exhibiting elastic deformation when subjected to compressive forces within a first range of forces and exhibiting plastic deformation when subjected to compressive forces within a second range of forces, wherein the first deformable member has a first threshold force level at a transition between the first range of forces and the second range of forces;

an auxiliary connector connectable between the first deformable member and a structural member of a building; and a second deformable member that, when subjected to compressive forces resulting from the relative displacement between the structural members of the building, absorbs at least another portion of the load resulting from the relative displacement between the structural members of the building, the second deformable member exhibiting elastic deformation when subjected to compressive forces within a third range of forces and exhibiting plastic deformation when subjected to compressive forces within a fourth range of forces, wherein the second deformable member has a second threshold force level at a transition between the third range of forces and the fourth range of forces, wherein the first threshold force level is less than the second threshold force level, the second deformable member comprising one or more stabilization members connected between the first deformable member and the auxiliary connector.

12. The structural device of claim 11, wherein the first deformable member comprises a core rod and a body surrounding and enclosing a substantial portion of the core rod, wherein the one or more stabilization members are connected between the body of the first deformable member and the auxiliary connector.

13. The structural device of claim 12, wherein at least one of the one or more stabilization members is fixedly connected to at least one of the body or the auxiliary connector.

14. The structural device of claim 12, wherein at least one of the one or more stabilization members is movably connected to at least one of the body or the auxiliary connector.

15. The structural device of claim 14, further comprising a channel connected to the at least one of the body or the auxiliary connector to enable movement of the at least one stabilization member relative thereto.

16. A structural device, comprising:

a first deformable member that, when subjected to axial tensile and compressive forces resulting from relative displacement between structural members of a building, absorbs at least a portion of a load resulting from the relative displacement between the structural members of the building, the first deformable member exhibiting elastic deformation when subjected to axial tensile and compressive forces within a first range of forces and exhibiting plastic deformation when subjected to axial tensile and compressive forces within a second range of forces, wherein the first deformable member has a first threshold force level at a transition between the first range of forces and the second range of forces, the first deformable member comprising a core rod and a body surrounding and enclosing a substantial portion of the core rod;

an auxiliary connector connectable between the first deformable member and a structural member of a building; and a second deformable member affixed to a portion of the first deformable member and that, when subjected to axial tensile and compressive forces resulting from the relative displacement between the structural members of the building, absorbs at least another portion of the load resulting from the relative displacement between the structural members of the building, the second deformable member exhibiting elastic deformation when subjected to axial tensile and compressive forces within a third range of forces and exhibiting plastic deformation when subjected to axial tensile and compressive forces within a fourth range of forces, wherein the second deformable member has a second threshold force level at a transition between the third range of forces and the fourth range of forces, wherein the first threshold force level is less than the second threshold force level, the second deformable member comprising one or more strap members connected between the body of the first deformable member and the auxiliary connector.

17. The structural device of claim 16, wherein at least one of the one or more strap members comprises a bent plate.

18. The structural device of claim 17, wherein the bent plate comprises a predetermined deviation from a straight line.

19. The structural device of claim 18, wherein the bent plate comprises a curved profile.

20. The structural device of claim 16, wherein the one or more strap members are fixedly connected to the body of the first deformable member and the auxiliary connector.

* * * * *